United States Patent [19]

Premack

[11] Patent Number: 5,034,722

[45] Date of Patent: Jul. 23, 1991

[54] CAPACITANCE DETECTION SYSTEM

[76] Inventor: Joshua Premack, 3833 York Ave. South, Minneapolis, Minn. 55410

[21] Appl. No.: 465,679

[22] Filed: Jan. 16, 1990

[51] Int. Cl.[5] ..... G08B 13/26

[52] U.S. Cl. ..... 340/562; 331/65

[58] Field of Search ..... 340/562, 825.7, 825.71; 331/65

[56] References Cited

U.S. PATENT DOCUMENTS

| | | | |
|---|---|---|---|
| 3,222,664 | 12/1965 | Premack | 331/65 X |
| 3,293,631 | 12/1966 | Premack | 331/65 X |
| 4,103,252 | 7/1978 | Bobick | 340/562 X |
| 4,169,260 | 9/1979 | Bayer | 340/562 |
| 4,222.045 | 9/1980 | Cholin | 340/562 X |
| 4,240,528 | 12/1980 | Kraus | 340/562 X |
| 4,366,473 | 12/1982 | Inoue et al. | 340/562 |

*Primary Examiner*—Glen R. Swann III
*Assistant Examiner*—Thomas J. Mullen, Jr.
*Attorney, Agent, or Firm*—Warren A. Sturm

[57] ABSTRACT

A capacitance sensing security system in which comparison/reference and sensing oscillator are coupled together to operate in substantial frequency synchronism, each of the oscillators includes an amplifier having input and output terminals and a feedback circuit including a capacitor connected to the input terminals, the feedback circuit connected to the sensing oscillator exhibiting a low capacitive reactance, the input terminals of the sensing oscillator being connected to one or more objects to be secured so that extraneous transient signals appearing at or on the objects do not affect the phase/frequency of the sensing oscillator, the resistive component being substantially greater than the resistance of the input terminals and is provided either by adjusting the value of the capacitive component in the feedback circuit and/or disposing a resistor in series therewith. An automatic tuner is provided to initially provide frequency synchronism between the reference/comparison and sensing amplifiers, and thereafter, a predetermined phase difference between the two amplifiers is provided by a suitable offset biasing supply for the sensing oscillator and the reference/comparison oscillator. Improved intruder detection includes controlled clocks and selectively operable registers to actuate an alarm condition indicator.

13 Claims, 5 Drawing Sheets

SHIFT REGISTER
+7.5
DATA
CLOCK
RESET
4015
DATA
CLOCK
RESET
1C
2C
3C
4C
5C
6C
N/C
N/C
4025
4025
4001
4001
CLOCK
REFERENCE LINE
A.P.C. LINE
+12
DATA
CLOCK
RESET
4015
DATA
CLOCK
RESET
1F
2F
3F
4F
5F
6F
N/C
N/C
4025
4001
TUNER
A
4001
43
42
B
1C
2C----6C
1F-----6F
+7.5
+7.5 SOURCE
ON/
OFF
42
42
44
41
44

CAPACITANCE DETECTION SYSTEM

BACKGROUND OF THE INVENTION

This invention relates generally to intruder detection systems and is more particularly directed to an improved intruder detection system that is operative to detect the presence of an intruder while being insensitive to extraneous phenomena which have, for a considerable period of time, rendered like intruder detection apparatus virtually useless because of false alarms generated by the existence of extraneous signals which have no relation to the presence or absence of an intruder. Such extraneous signals might include nature generated signals such as lightning, or manmade signals such as might occupy the space around an electrical power transmission facility.

The prior art includes:

| U.S. Pat. No. | Title | Patentee | Issue Date |
|---|---|---|---|
| 3,222,664 | DETECTION APPARATUS | J. Premack | Dec. 3, 1965 |
| 3,293,631 | DETECTION APPARATUS | J. Premack | Dec. 20, 1966 |
| 4,103,252 | CAPACITIVE TOUCH-ACTIVATED TRANSDUCER SYSTEM INCLUDING A PLURALITY OF OSCILLATORS | Bobick | July 25, 1978 |
| 4,169,260 | CAPACITIVE INTRUSION DETECTOR CIRCUITRY UTILIZING REFERENCE OSCILLATOR DRIFT | Bayer | Sep. 25, 1979 |
| 4,222,045 | CAPACITIVE SHIFT FIRE DETECTION DEVICE | Cholin | Sep. 9, 1980 |
| 4,240,528 | FIELD SENSOR | Kraus | Dec. 23, 1980 |
| 4,366,473 | CAPACITIVELY COUPLED ELECTROMAGNETIC INTRUSION WARNING SYSTEM | Inoue et al. | Dec. 28, 1982 |

MAGAZINE ARTICLE

A publication authored by the inventor entitled, "Twin Oscillators Form Intruder Detector" published Jan. 23, 1975 in *ELECTRONICS* magazine at pp. 88 and 89.

Included in the prior art are my U.S. Pat. Nos. 3,222,664 and 3,293,631 which are, in turn, referred to in U.S. Pat. No. 4,169,260, pertaining to the field of invention, but direct to the solution of a problem unrelated to the present invention. In my published article in *ELECTRONICS*, the concepts present in my patents are shown embodied in improved solid state versions of the invention of my earlier patents.

To my knowledge, none of the prior art devices identified above, or known to me, are capable of presenting a uniquely low susceptability or insensitivity to outdoor environmental conditions that continue to cause false alarm signals to the point that the authorities who typically respond to alarm signals, have become lax about responding or, in the alternative, levy a sizeable sum for responses to false alarms. This has resulted in considerable lack of acceptance of capacitance alarm systems capable of exhibiting the sensitivity of my system to the presence of intruders.

SUMMARY OF THE INVENTION

A system, method and apparatus for detecting very small increments of capacitance, as by an intruder in a secured area.

An object of my invention is to provide an improved security system which operates on the change of capacitance principle.

Another object of my invention is to provide an improved security system which is insensitive to normal environmental phenomena, or extraneous signals, and is highly sensitive to changes in capacitance of secured objects.

Another object of my invention is to provide an improved intruder detection system embodying an adaptive apparatus for tuning a pair of reference/comparison and sensing oscillators to an operational frequency.

Another object of my invention is to provide intruder detection apparatus having an improved signal detector which may be adjusted for the detection of different types of intruders.

A further object of my invention is to provide an improved method of securing a plurality of objects within a given volume so as to accommodate day-to-day changes in the number of secured objects.

A still further object of my invention is to provide an improved intrusion detector method and apparatus exhibiting a uniquely high insensitivity to extraneous signals typically found outdoors, and high sensitivity to small changes in capacitance as occasioned by the presence of an intruder.

BRIEF DESCRIPTION OF THE DRAWINGS

These and other objects of my invention will become apparent from a consideration of the appended specification, claims and drawings in which:

DESCRIPTION OF THE PREFERRED EMBODIMENT

Figure 1:
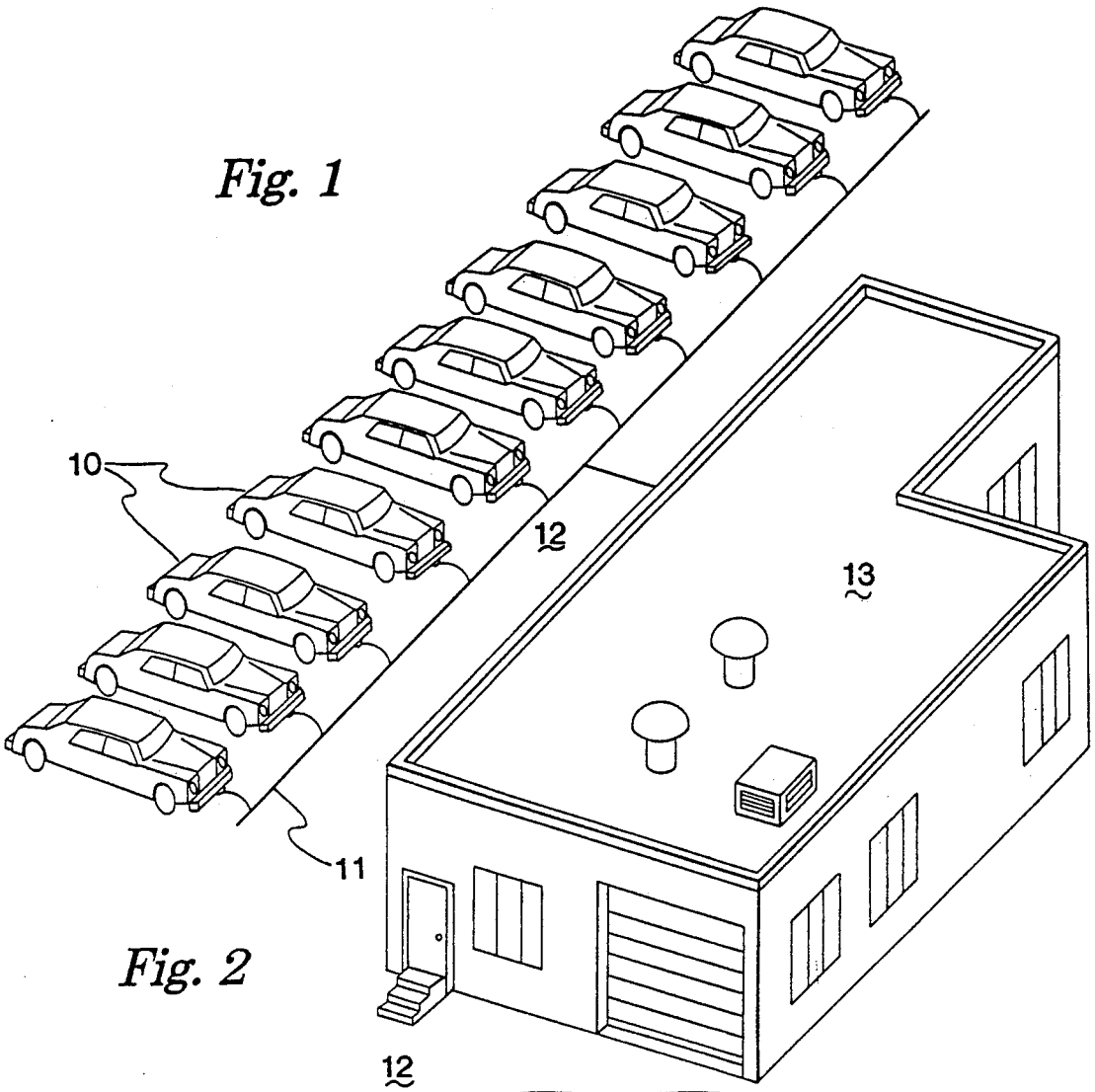
FIG. 1 is a perspective sketch of a typical installation for my invention.

Referring now to the drawings, in which like elements are identified by like reference characters, a secured volume exists around and about a car dealership building identified by reference character 13 which is typically associated with an inventory of automobiles 10 that are connected through a suitable antenna means 11 and disposed within a secured volume, identified generally by reference character 12.

Figure 3:
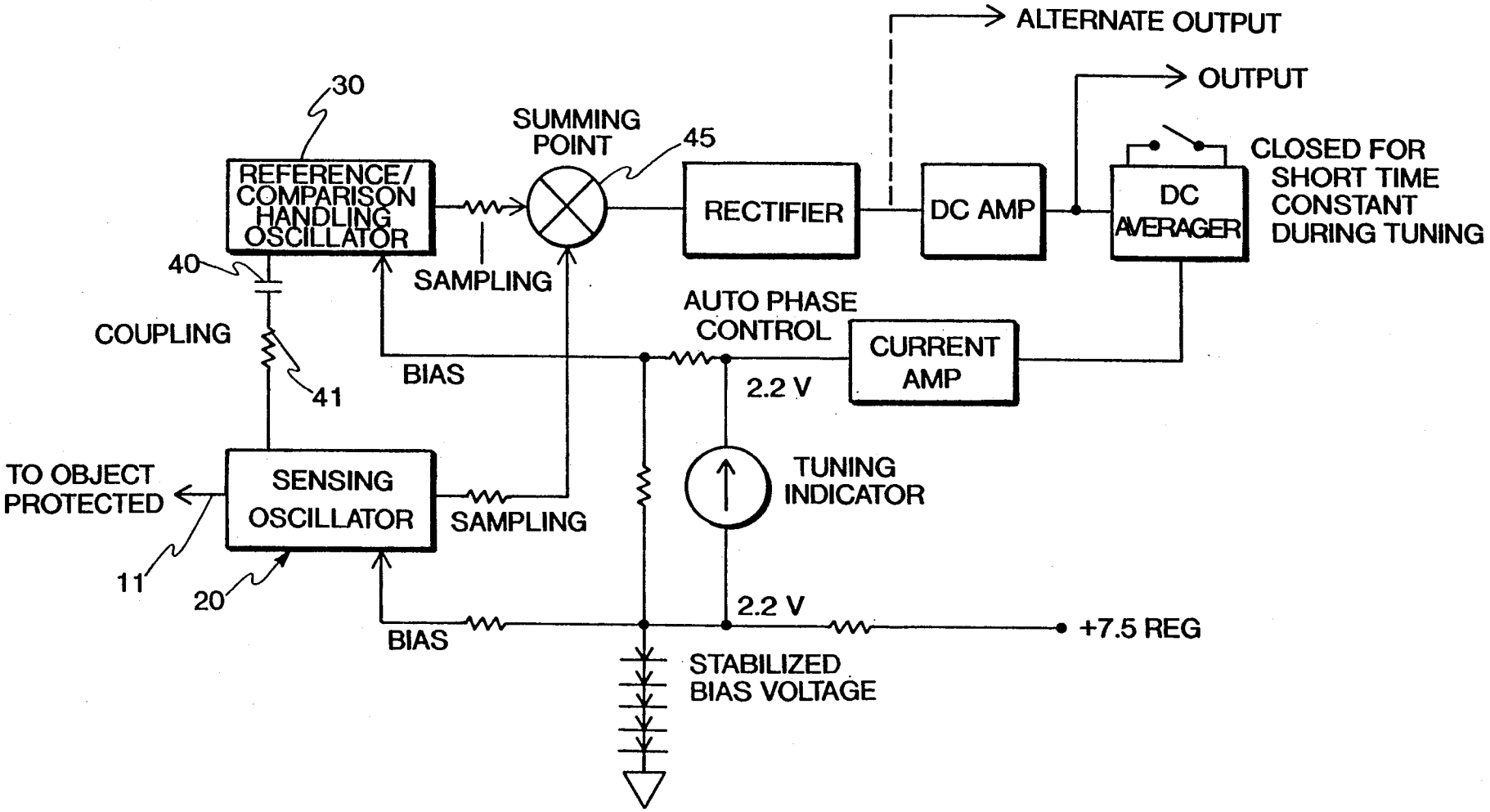
FIG. 3 is a schematic block diagram generally illustrating an intruder detection apparatus of the prior art type referred to above.

As is illustrated on FIG. 3 of the drawings, a typical system for sensing a change in capacitance may be used to provide an indication that an object to which it is connected has experienced a change in capacitance. The apparatus of FIG. 3 is comprised of a sensing oscillator 20, a reference/comparison/tracking oscillator 30 that is coupled to sensing oscillator 20 through capacitor 40 and resistor 41 and oscillator 30 and sensing oscillator 20 are connected to a summing point 45 through sampling resistors 33 and 26, respectively. The output of summing point 45 is connected to a suitable rectifier that is, in turn, connected to a d.c. amplifier, the output of which may be applied to a suitable output processing means and to a d.c. averager which is connected to control the operation of reference/comparison/tracking oscillator 30 through a suitable current amplifier to provide an automatic phase control which maintains the phase difference between oscillators 20 and 30 at a predetermined difference, typically, 150–160 degrees. The oscillators may be comprised of any suitable quality components which provide a relatively stable mode of operation when used in conjunction with the automatic phase control which is dependent upon the stabilized bias voltage source.

Figure 2:
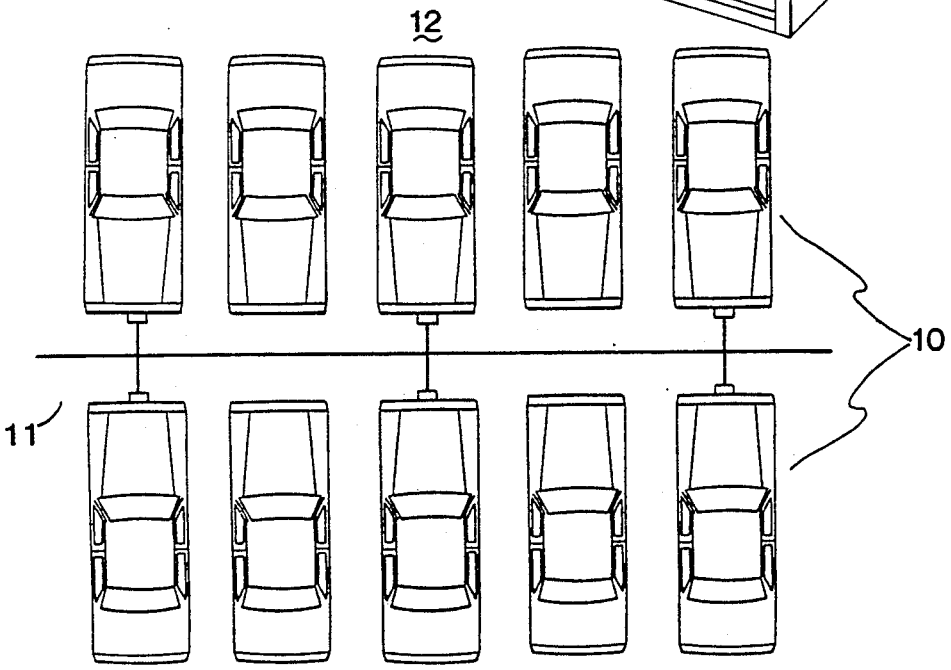
FIG. 2 is a plan view of a secured area.

Sensing oscillator 20 is shown having an input terminal to be connected through antenna 11 to an object to be protected, as in FIGS. 1 and 2.

Figure 4:
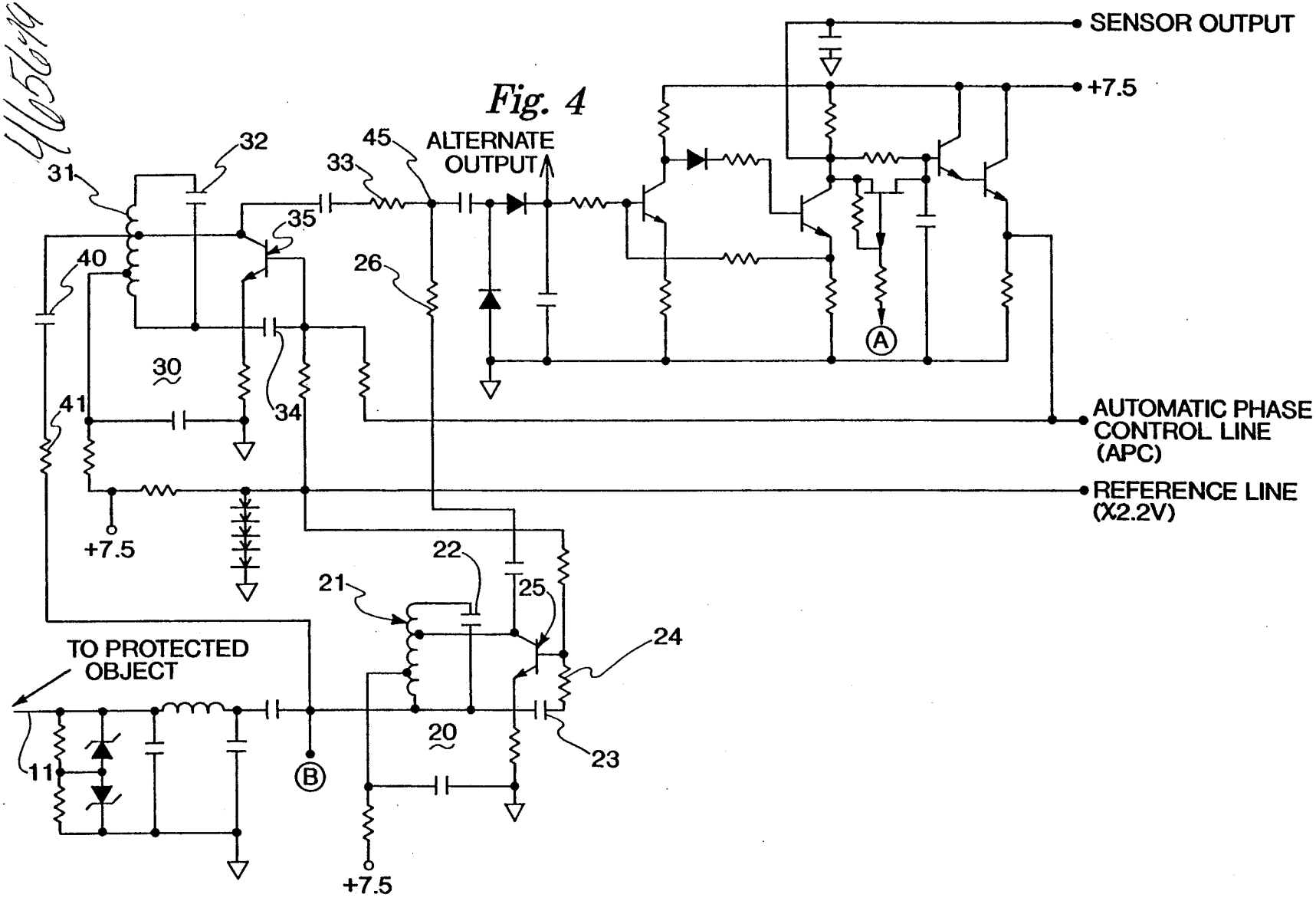
FIGS. 4, 5 and 6 are schematic and block diagrams of a complete intruder detection system embodying the principles of my invention.

In FIG. 4, a detailed schematic diagram includes oscillators 20 and 30, summing point 45, a rectifier converting the output of summing point 45 to a varying d.c. voltage, a d.c. amplifier having an output identified as SENSOR OUTPUT and shown connected to a d.c. averager that is connected to a current amplifier, shown in the form of a Darlington transistor device, the output of which is connected to the line labeled APC for controlling the phase of reference/comparison/tracking oscillator 30 with respect to sensing oscillator 20. Sensing oscillator 20 includes a transistor 25 having base and emitter electrodes constituting input terminals and emitter-collector electrodes constituting output terminals connected to a frequency determining tank circuit comprised of a tapped inductance 21, a capacitor 22, and a feedback capacitor 23 which, in a preferred embodiment of my invention, is selected to provide a capacitive reactance that is low with respect to the impedance of the input terminals of transistor 25. A further resistance 24 is shown connected intermediate the base electrode and capacitor 23 and may be provided to enhance the operation of oscillator 20 in reducing its sensitivity to extraneous, undesired signals, such as lightning, electric fields or the like. The lower end of inductance 21 is shown connected to antenna 11 through a suitable network comprised of resistors, diodes, capacitors, and inductors and is also connected to a variable capacitance means for tuning purposes, to be described below. Transistor 25 is normally biased through a resistor connected between the base electrode and the regulated source of reference potential identified as REFERENCE LINE.

Reference/comparison/tracking oscillator 30 includes a transistor 35 having input terminals comprised of the base and emitter electrodes and output terminals comprised of the base and collector electrodes and includes a frequency determining circuit comprised of tapped inductance 30, a capacitor 32, and a feedback capacitor 34 selected to exhibit a relatively high capacitive reactance that, in a preferred embodiment, was determined to be substantially equal to the impedance of the input terminals of transistor 35. A suitable tap on inductance 31 is shown connected to the lower end of inductance 21 in sensing oscillator 20, through capacitor 40 and resistor 41 to cross link the two oscillators.

With specific references to FIG. 4 of the drawings, transistors 25 and 35 may be comprised of type 2N5962 transistors having base-emitter impedance of approximately 5000 ohms; frequency determining tank circuits 21, 22, 31 and 32 comprised of approximately 3MHY inductors and 7500 picofarad capacitors; feedback capacitor 23, 0.33 microfarad; resistor 24, in the range of 5K to 20K ohms; and capacitor 34, 1000 picofarads. The oscillators are nominally operable at a frequency of 33,000 Hertz.

Figure 5:
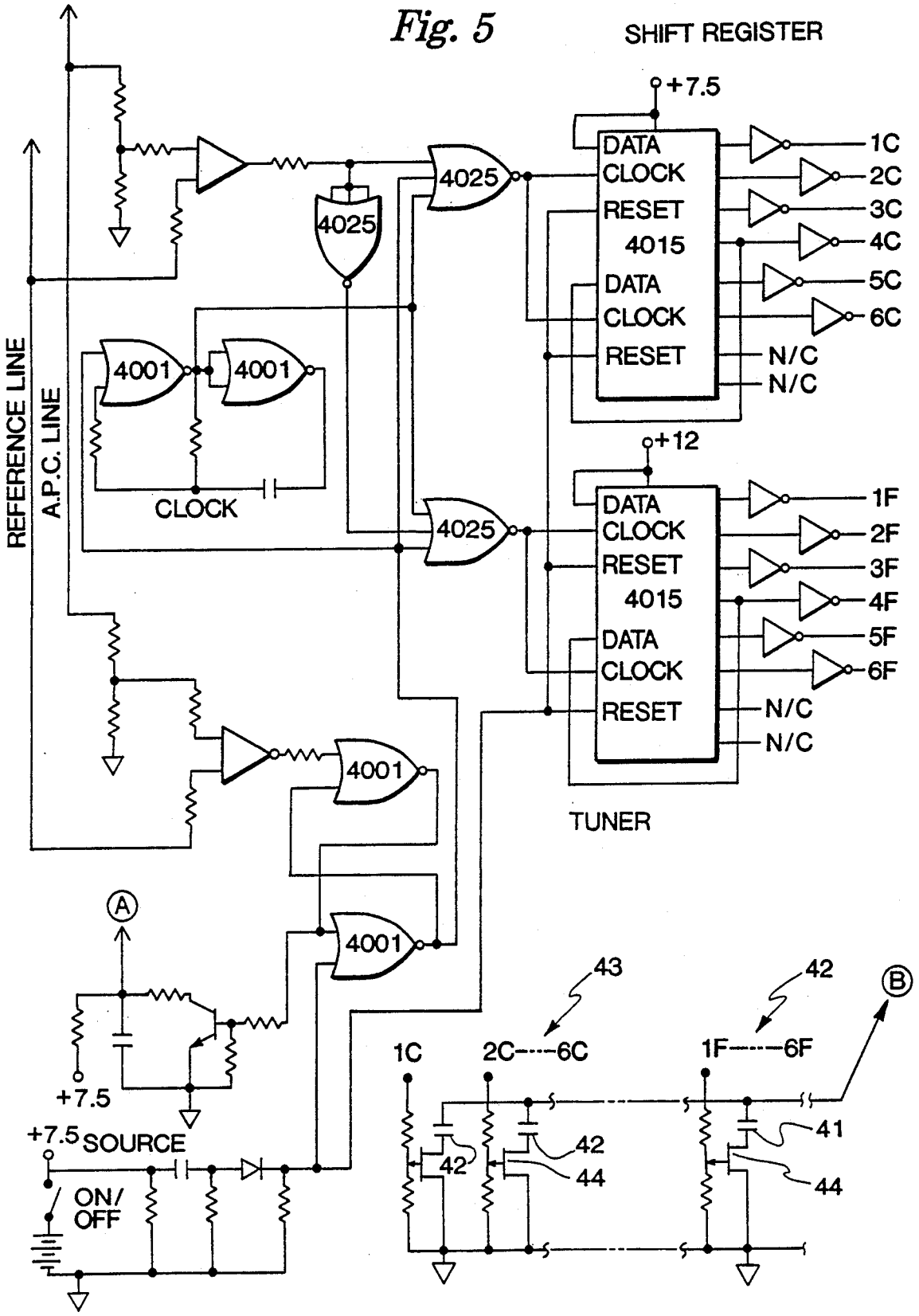

FIG. 5 illustrates a tuner for initialization of my system, and it may be seen that the tuner is operable from the reference line, a stabilized source of potential and bias for oscillators 20 and 30 and the APC, or automatic phase control line, which reflects the difference in phase between the outputs of oscillators 20 and 30 and is used in connection with the circuitry illustrated on FIG. 5 to vary the amount of capacitance that may be added to the lower end of tapped inductance 21 in oscillator 20 to adjust the phase and frequency of oscillator 20 to that of oscillator 30 through the connection of one or more fine and coarse capacitors 41 or 42, respectively, through conductor B.

The tuner of FIG. 5 is comprised of a fine and coarse register, each having a plurality of output terminals connected to suitable conducting means for adding capacitors, in sequence, to point B on FIG. 4 of the drawings to modify the frequency of sensing oscillator 20. The registers are operable from a pair of nand gates that are, in turn, operable from a comparison means to gate the output of a clock to a clock input terminal on the fine and coarse registers until a predetermined phase difference between oscillators 20 and 30 exists. The 4025 nor gates are further controlled by a second comparison means which will stop the tuning action when the phase difference between oscillators 20 and 30 is below a predetermined value. At this time, a signal is initiated to stop the conduction of the field effect transistor connected across the output resistor connected to the input of the Darlington transistor of FIG. 4.

As seen on FIG. 5, an on-off switch for my apparatus is configured to reset the tuning registers which, in turn, renders the aforementioned field effect transistor, across the resistor at the input of the Darlington output stage on FIG. 4, conductive.

Figure 6:
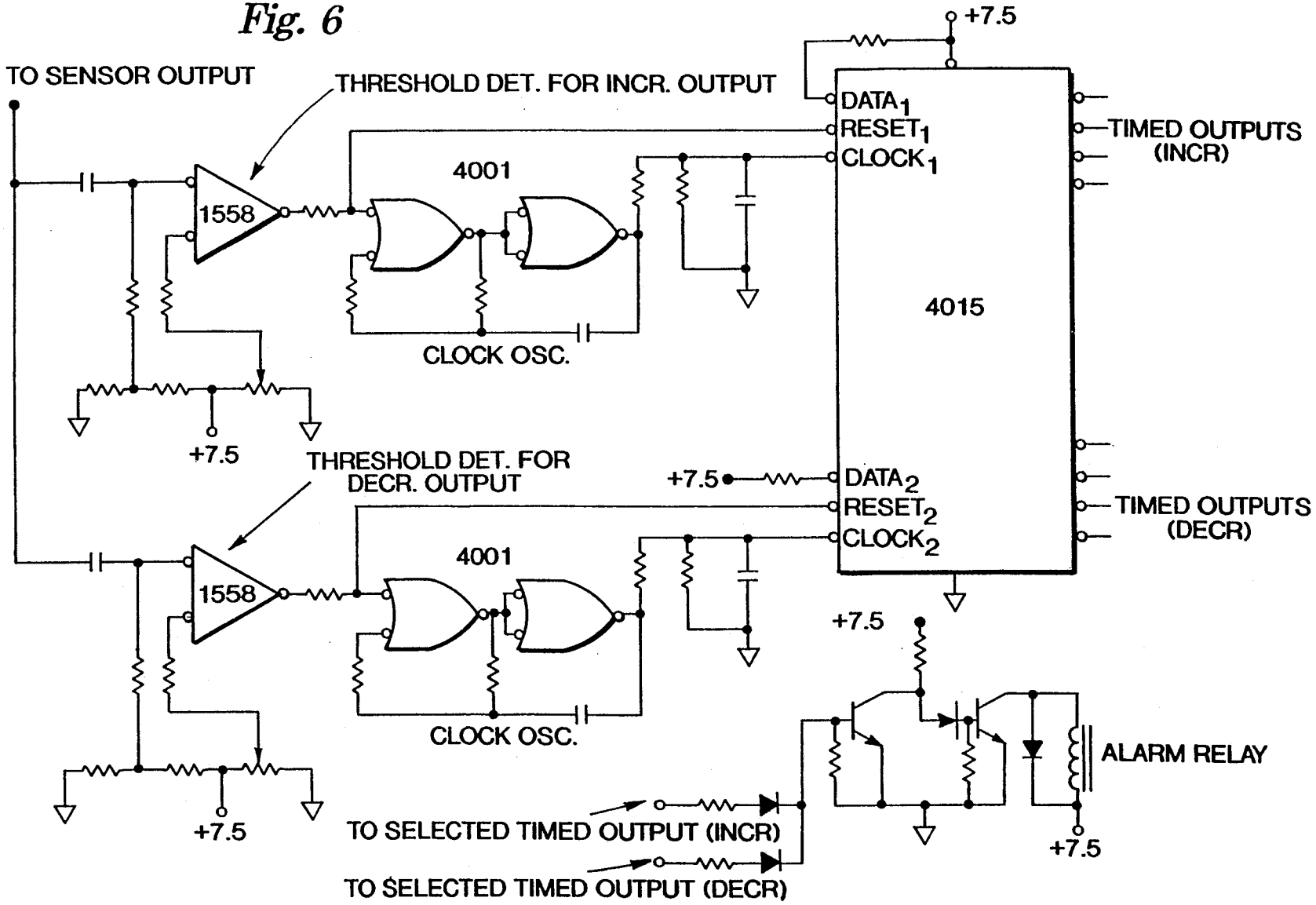

Referring to FIG. 6 of the drawings, my alarm signal processor is shown having an input connected to the sensor output indicated on FIG. 4 of the drawings and includes first and second threshold detectors utilizing op amp comparators 1558 and resistive networks to provide an output signal indicative of increasing or decreasing output as reflected by the proximity and/or movement of an intruder within the volume 12 adjacent the protected objects 10. Each of the threshold detectors is connected to a clock comprised of 2 dual input nor gates 4001 which is, in turn, connected to the reset and clock input terminals on a register 4015 which includes a first set of timed outputs for increasing capacitance and a second set of timed outputs for decreasing capacitance, either one of which may be suitably connected to an alarm relay through the indicated solid state components on the central lower portion of FIG. 6 of the drawings. Whichever one of the timed outputs that is selected will determine the sensitivity of my apparatus to the presence of an intruder.

OPERATION OF THE ILLUSTRATED EMBODIMENT

Referring to the drawings, my apparatus is installed, preferably within a building 13 that has a volume 12 associated with it and a plurality of objects to be protected, automobiles 10, are connected through an antenna 11 to sensing oscillator 20.

At the onset, assuming my intruder detection system has been deactivated, as would normally occur at the beginning of each business day, it is necessary to initialize the operation of my system by synchronizing the operation of sensing oscillator 20 and reference/comparison/tracking oscillator 30. This is done by closing the on-off switch on a d.c. power supply which clears the fine and coarse registers and sets the 4001 flip-flop to turn the FET controlling transistor "on" to turn the FET "on", shorting out the resistor connected to the d.c. averaging circuit connected to the output of the d.c. amplifier in my sensor by allowing the field effect transistor connected in parallel with the resistor to remain conductive. If the frequency and phase difference between sensing oscillator 20 and reference/comparison/tracking oscillator 30 is within the desired limits, namely, the same frequency and a phase difference of 150–160 degrees, the comparison of the outputs of oscillators 20 and 30 at summing point 45 will be such as to provide the proper voltage at the output of the d.c. amplifier and therefore, the enabling of the operation of the tuner will stop as the desired operational parameters have been obtained. On the other hand, in the typical event of a lack of frequency synchronism and/or desired phase difference, the tuner will become operable to sense the difference between the APC line and the reference line, reflecting the frequency or phase difference, occurring at summing point 45, to enable the output of the clock to be applied to the respective registers for the coarse and fine tuning so that the necessary fine and coarse tuning capacitors may be added to the lower end of tapped inductance 21 on sensing oscillator 20 to thereby render sensing oscillator 20 operable at the same frequency and at a predetermined phase difference with respect to the operation of oscillator 30. This occurs automatically in the illustrated embodiment of FIG. 5 and may be observed as a substantial null on a tuning indicator as indicated in the block diagram of FIG. 3. At this point in time, the voltage signal applied to point A on FIG. 4 of the drawings slowly rises, and thereafter renders the FET non-conductive, the tuner becomes inoperative and the d.c. averager connected to the output of the d.c. amplifier, in my sensor, is rendered operable to maintain the operation of reference/comparison/tracker oscillator 30 at a predetermined phase difference with respect to the operation of sensing oscillator 20.

At this time, my system may be considered "armed" and prepared to sense the presence of an intruder of the type that may cause a change of as little as four to ten picofarad capacitance of the load connected to antenna 11. As may be appreciated, this is a very small change in capacitance and remains reliably detectable.

During any given period of time and perhaps simultaneously, an extraneous signal, as might be caused by lightning, electrical transients on a power line, or the like, may find its way to antenna 11 and therewith be transmitted to the input terminals of the transistor forming a part of the oscillator in sensing oscillator 20. However, due to the relatively lower impedance presented by the capacitive reactance of capacitor 23 (as distinguished from the high capacitive reactance exhibited by capacitor 34) on oscillator 30, the net effect of the extraneous signal does not substantially affect the conduction of transistor 25 and the signal is thereupon conveyed to ground from the base to the emitter on transistor 25 with no effect on the phase or frequency of operation of sensing oscillator 20. The substantial elimination of the effect of these extraneous signals, appearing as voltage pulses and the like, may be increased by inserting a resistor 24 of a value substantially greater than the nominal impedance of the base-emitter electrodes of the input terminals on transistor 25, although my invention has been observed to operate successfully solely with capacitor 23.

My alarm system has been satisfactorily operated in the course of electrical storms and interference of substantial magnitude without rendering any false alarms and while providing very satisfactory alarming during the presence of an intruder.

As may now be appreciated, my alarm method and system provides operational characteristics which are essentially free from the undesired effects of extraneous voltage type signals while retaining a high degree of sensitivity to the capacitance changes associated with the presence of an intruder. In the operation of my system, a pair of similar oscillators, a sensing and a reference/comparison/tracking oscillator, are coupled together and, initially, the frequency of the sensing oscillator is adjusted to be within a number of degrees of phase difference with respect to the frequency of operation of the reference/comparison/tracking oscillator. Thereafter, the sensing oscillator is affected substantially and primarily by the capacitance added to or subtracted from objects to be protected that are connected in the frequency determining portion of my sensing oscillator and any such changes are compared in phase by comparison with the output of the reference/comparison/tracker oscillator and thereafter processed to determine the existence of an intruder. During the operation of my intruder detection system, namely, when an intruder is not present, the reference/comparison/tracker oscillator is caused to operate within a predetermined phase relationship with the sensing oscillator through the use of an automatic phase control which adjusts the phase of oscillator 30 to within a predetermined phase angle of the output of sensing oscillator 20.

Describing my invention in a somewhat different light, protected objects, indoors or outdoors, are connected to a portion of the frequency determining circuit of an oscillator. An approach to a protected object generates a very small change in the phase difference between this oscillator and a comparison oscillator and it is this change which is processed to indicate an intrusion. A very small phase change, approximately 0.15 degrees, used to generate an intrusion signal, is a result of the protected object's being connected to only a small portion of the frequency determining circuit. However, this connection allows the protection of objects having a Q of one or less and normally having high shunt leakages. The use of a very small phase change to signal an alarm for an intruder, requires that extraneous signals, as power line noise and or heavy atmospherics, do not produce phase changes comparable to those required for intruder detection. The problem of the presence of extraneous signals is alleviated by the use of a very low reactance and/or additional series resistance in the feedback circuit of a sensing oscillator so that the signals may pass through the oscillator without an accompanying phase shift in the operation of the oscillator. On the other hand, the reference/comparison/-tracking oscillator may utilize a high reactance feedback circuit to maintain the predetermined phase difference between the sensing and the reference/comparison/tracking oscillator.

Other features and advantages of my invention will become apparent to those skilled in the art, and it is my intention to be limited only by the scope of the appended claims.

I claim:

1. Detection apparatus comprising, in combination:

a reference/comparison/tracking oscillator including current controlling means having input and output terminals and frequency determining feedback means exhibiting high capacitive reactance substantially the same as the impedance of said input terminals;

a sensing oscillator including current controlling means having input and output terminals and feedback means exhibiting low capacitive reactance relative to the impedance of said input terminals;

means interconnecting said oscillators for maintaining said oscillators in frequency synchronism and of a predetermined phase difference;

means connecting said sensing oscillator to an object or objects to be protected whereby the frequency/-phase of said sensing oscillator varies with the variations in the capacitance of said object caused by the proximity of a mass;

means for determining a change in the phase difference between said reference oscillator and said sensing oscillator; and means for indicating variations in said phase difference.

2. The apparatus of claim 1 in which the means for determining a change in the phase difference between said reference oscillator and sensing oscillator is a detector.

3. The apparatus of claim 1 in which the impedance of the feedback means in the sensing oscillator is of low resistance compared to the impedance of the input terminals.

4. The apparatus of claim 1 in which tracking means are operable to determine the rate of change of phase difference between the reference and the sensing oscillators.

5. Detection apparatus comprising reference/comparison and sensing oscillator means, each having input terminals connected to a feedback means and including current controlling means exhibiting a resistance which varies with current flow therethrough;

said feedback means including capacitive means, the feedback means on said sensing oscillator means exhibiting a low capacitive reactance much less than the resistance of said current controlling means whereby transient extraneous signals do not affect the frequency/phase of the oscillations of said sensing oscillator means.

6. The apparatus of claim 5 further including means for determining a change in the phase difference between said reference oscillator means and sensing oscillator means.

7. The apparatus of claim 5 in which the feedback means include resistance means.

8. The apparatus of claim 5 in which tracking means are connected to the reference and sensing oscillator means to determine the rate of change intermediate said reference and said sensing oscillator means.

9. The method of intruder detection which comprises the steps of:

providing a reference/comparison/tracking oscillator including frequency determining means and of variable frequency;

providing a sensing oscillator including frequency determining means and of variable frequency;

initially adjusting the frequency of the sensing oscillator to the frequency of the reference comparison oscillator;

thereafter continuously adjusting the frequency of the reference comparison oscillator to track the frequency of the sensing oscillator by comparing the outputs and maintaining a predetermined phase angle between &:he reference/comparison oscillator and the sensing oscillator; and thereafter detecting phase angle changes in excess of a predetermined amount.

10. The method of claim 9 in which the last step includes detecting the rate of change of phase angle.

11. The method of intruder detection which comprises the steps of:

establishing a reference/comparison oscillator including frequency determining means and input and output terminals;

establishing a sensing oscillator having frequency determining means and input and output terminals;

connecting feedback capacitance means, having a capacitive reactance smaller than the impedance of said input terminals, to the input terminals on said sensor oscillator;

connecting an object to be secured to the frequency determining means of said sensing oscillator;

causing said oscillators to be operative at the same frequency and at a predetermined phase angle difference; and comparing the phase of said reference/comparison oscillator with the phase of said sensing oscillator for the existence of a difference in phase angle occurring in excess of a predetermined rate.

12. The method of claim 11 in which the last step includes a determination of the magnitude or amount of change in phase angle.

13. The method of claim 11 in which the last step includes the measure of rate of change in the phase angle.

* * * * *